US008857571B2

(12) United States Patent
Henneau

(10) Patent No.: US 8,857,571 B2
(45) Date of Patent: Oct. 14, 2014

(54) OPERATING STATE MONITORING OF SUPPORT APPARATUS OF AN ELEVATOR SYSTEM

(75) Inventor: Philippe Henneau, Zurich (CH)

(73) Assignee: Inventio AG, Hergiswil (CH)

( * ) Notice: Subject to any disclaimer, the term of this patent is extended or adjusted under 35 U.S.C. 154(b) by 544 days.

(21) Appl. No.: 13/258,199

(22) PCT Filed: Apr. 15, 2010

(86) PCT No.: PCT/EP2010/054959

§ 371 (c)(1),
(2), (4) Date: Sep. 21, 2011

(87) PCT Pub. No.: WO2010/121944

PCT Pub. Date: Oct. 28, 2010

(65) Prior Publication Data

US 2012/0024637 A1 Feb. 2, 2012

(30) Foreign Application Priority Data

Apr. 20, 2009 (EP) ..... 09158272

(51) Int. Cl.
*B66B 1/34* (2006.01)
*B66B 5/12* (2006.01)

(52) U.S. Cl.
CPC .. *B66B 5/12* (2013.01); *B66B 5/125* (2013.01)
USPC ..... 187/393; 187/411

(58) Field of Classification Search
USPC ..... 187/247, 264–266, 343, 344, 347, 350, 187/391, 393, 404, 411, 412, 414; 177/132, 177/142, 147; 73/1.09, 1.13, 1.15, 763, 73/783, 796, 811, 828
See application file for complete search history.

(56) References Cited

U.S. PATENT DOCUMENTS

| | | | | |
|---|---|---|---|---|
| 4,467,895 | A * | 8/1984 | Smith et al. | 187/391 |
| 6,123,176 | A * | 9/2000 | O'Donnell et al. | 187/393 |
| 6,443,266 | B2 * | 9/2002 | Murakami et al. | 187/401 |
| 6,715,587 | B2 * | 4/2004 | Sittler et al. | 187/401 |
| 6,966,408 | B2 * | 11/2005 | Sweet | 187/264 |
| 7,481,299 | B2 * | 1/2009 | Mustalahti et al. | 187/264 |
| 7,650,972 | B2 * | 1/2010 | Aulanko et al. | 187/350 |
| 7,806,237 | B2 * | 10/2010 | Aulanko et al. | 187/265 |
| 8,011,480 | B2 * | 9/2011 | Fischer | 187/393 |
| 8,602,173 | B2 * | 12/2013 | Berner | 187/393 |
| 2012/0152663 | A1 * | 6/2012 | Legeret et al. | 187/404 |

FOREIGN PATENT DOCUMENTS

| | | | |
|---|---|---|---|
| DE | 102006027989 | A1 | 12/2007 |
| EP | 1953108 | A1 | 8/2008 |
| FR | 2618420 | A1 | 1/1989 |
| WO | 2006082460 | A1 | 8/2006 |
| WO | 2007144456 | A1 | 12/2007 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator system includes at least one elevator car and at least one counterweight, which can be moved in opposite directions from each other on at least one guide track in an elevator shaft by a support apparatus guided over a traction sheave of a drive. At least one monitoring device detects a slackening of the support apparatus, wherein the monitoring device is disposed at a deflection roller for the support apparatus.

19 Claims, 6 Drawing Sheets

OPERATING STATE MONITORING OF SUPPORT APPARATUS OF AN ELEVATOR SYSTEM

FIELD OF THE INVENTION

The present invention relates to an elevator installation in which at least one monitoring device or device for operational state monitoring of the or each support apparatus for the elevator car or for the counterweight is provided in an elevator installation.

BACKGROUND OF THE INVENTION

An elevator installation usually comprises an elevator car and at least one counterweight, which are moved in opposite sense in an elevator shaft. The elevator car and the at least one counterweight in that case run in or along guide rails and are supported by at least one support means, which is guided over a driving drive pulley. The support means usually consists of one or more sheathed steel cables, one or more synthetic fiber cables, one or more flat or profiled belts (wedge-ribbed belts) or a parallelly extending composite of the respectively mentioned constructions, in which each individual support means can be guided over a respective individual drive pulley.

It is possible with such modern support means to realize such a high level of traction on the driving drive pulley that, for example, the elevator car is raised further although the counterweight could be obstructed in its downward movement by an unforeseen jamming in the elevator shaft or by an unforeseen seating on the shaft floor buffers. The same problem can arise with the counterweight if the elevator car should sit on the shaft floor buffers. This lifting up of a load—be it the elevator car or the counterweight—at one side of the drive pulley without the provided counter-load at the other side of the drive pulley running conjunctively to freely rise is impermissible and can lead to dangerous states (dropping back of the elevator car or the counterweight).

Accordingly, monitoring devices for detection of a relaxed, slack support means have been developed. They are based, as disclosed in, for example, European published specification EP-A1-1 953 108, on a spring-reinforced mounting of the overall drive and a deflecting unit with at least two further rollers for the support means.

A device for stopping falling is known from the document WO 2006/082460, in which a support means breakage prevents crashing down of the counterweight. The device for stopping falling is mounted at the counterweight and triggers arrest of the counterweight as soon as a force threshold is fallen below. If in the solution according to WO 2006/082460 fracture or loosening of the support means occurs then a resiliently mounted axle is displaced, which triggers the device for stopping falling.

A sensor device is known from the document DE 10 2006 027989 A1, which monitors individual support means, here specifically chains. The corresponding sensor device is independent of the drive elements, deflecting rollers and other load-bearing parts of the described elevator installation.

The document FR 2 618 420 discloses a device for monitoring an individual support means at its deflecting roller, wherein in the case of slackness of the support means a switch is actuated which switches off the drive. The device according to FR 2 618 420 thus monitors the slackness of an individual cable and not the slackness of the entire support means run. In the case of occurrence of a slack support means there is intervention in the control of the elevator car by way of an electrical contact.

International published specification WO-A1-2007/144456 thereagainst discloses a direct fastening, which is also spring-loaded, of the support means. A relaxation of the spring thus occurring at the fixed fastening point of the support means due to load relief thereof triggers a switch which switches off the drive. It is disadvantageous with this solution that it is suitable only for elevator installations with a small conveying height and that there is no detection at the directly affected support means sections between drive pulley and support roller of the elevator car or between drive pulley and support roller of the counterweight.

The disadvantages of these two solutions according to the prior art are on the one hand the constructional outlay and on the other hand the difficulty of detecting a reliable trigger value. Particularly in the case of large conveying heights and thus lengthy support means sections the high intrinsic weight of the support means emerges as unfavorable inasmuch as a difference between loaded operating state of the support means and slack state of the support means is detectable only with difficulty.

SUMMARY OF THE INVENTION

An object of the present invention is to propose a monitoring device for the operating state of the single or plural support means of an elevator installation, which is distinguished by a construction which is simpler, involves less adjustment and maintenance and is thus more economic and which avoids the stated disadvantages of the prior art, particularly to guarantee an improved detection of a slack support means due to a disturbance.

The object is fulfilled in the first instance in the conceptual arrangement of a monitoring device which is disposed neither at the fixed fastening points of the support means nor at the mounting of the drive unit overall, but at a deflecting roller for the support means. In accordance with the invention there is thereby avoidance of the disadvantage that the intrinsic weight of the support means—which can be considerable particularly in the case of large conveying heights—is relevant in the detection measurement of the monitoring device.

According to a first basic variant of the monitoring device according to the invention a deflecting roller for the support means is provided at the support means section between the drive pulley and a first point of engagement of the support means with the elevator car. In the following, there is usually to be understood by the term "point of engagement of the support means with the elevator car" or "point of engagement of the support means with the counterweight" the support roller or the support rollers by which the support means is guided in order to support the elevator car or the counterweight. The elevator car can in this regard fundamentally be supported by a support means which is guided by only one support roller. This one support roller is usually arranged approximately centrally or, however, also eccentrically at the upper side of the elevator car or the counterweight. This one support roller is thus looped around over approximately 180 degrees of its circumference by the support means. In order that the support means is not excessively bent and loaded the support roller thus has to have a relatively large diameter. Support arrangements for the elevator car or also the counterweight are thus frequently realized with smaller—at least two—support rollers or pairs thereof as a so-called underslinging. These support arrangements have the significant advantage that the support means is bent around only approximately 90 degrees of the circumference of a respective support roller. Such an underslinging of the elevator car or the counterweight can in turn be realized in that the support means also actually loops under the body of the elevator car or the counterweight, i.e. the at least two support rollers are arranged at the underside of the elevator car or the counterweight. Analogously thereto, there are also support arrangements in which at least two support rollers are arranged at the upper side of the elevator car or the counterweight. In every instance the first point of engagement of the support means with the elevator car or the first point of engagement of the support means with the counterweight is represented by the single support roller or—in the case of the last-described underslung supporting arrangements (be it at the underside or at the upper side of the elevator car or the counterweight)—by the first support roller lying closest to the drive pulley, which relates to the developed length of the support means. A second point of engagement of the support means with the elevator car or a second point of engagement of the support means with the counterweight comes into consideration only in the case of the underslung support arrangements and is represented by the support roller furthest away from the drive pulley.

Moreover, the described support rollers in terms of terminology represent at the same time deflecting rollers, because, like every other deflecting roller, they deflect an original direction of the support means into a new direction. The present invention describes a monitoring device which is arranged at a deflecting roller, thus selectably at the support rollers and, however, also at deflecting rollers which do not exert a supporting function.

With respect to further terminological clarity the present invention usually defines for a support point two fixed fastening points at which the support means is, for example, fastened in stationary position in the upper region of the elevator shaft. The support means is, for example, guided by way of a drive pulley which is usually arranged approximately centrally between these stationary support means fastening points and thus forms two loops. The elevator car is supported in one loop by at least one support roller and the counterweight in the other by at least one support roller. The support means thus forms several support means sections or support means portions, which during operation of the elevator installation vary in the respective length thereof. The support means sections lie between respective points of engagement or application of force. Thus, for example, a first support means section of the overall support means is formed between one of the stationary fastening points and a (first) support roller of the counterweight or a (first) point of engagement of the support means with the counterweight. A second support means section of the overall support means is formed between the (first) support roller of the counterweight or the (first) point of engagement of the support means with the counterweight (or, depending on the respective form of suspension, between a second support roller of the counterweight or a second point of engagement of the support means with the counterweight) and the drive pulley. This second support means section is also termed in the following support means section at the counterweight side. A third support means section of the overall support means is formed between the drive pulley and a (first) point of engagement of the support means with the elevator car or a (first) support roller of the elevator car. This third support means section is also termed in the following support means section at the car side. A fourth, and usually last, support means section of the overall support means is formed between the (first) support roller of the elevator car or the (first) point of engagement of the support means with the elevator car or—if the elevator car is underslung or supported by at least two support rollers—a second support roller of the elevator car or a second point of engagement of the support means with the elevator car and the other stationary fastening point. The support means sections between the support rollers of the counterweight or between the support rollers of the elevator car—insofar as in each instance at least two support rollers are arranged—were disregarded in this enumeration of possible support means sections. By "first" point of engagement of the support means with the elevator car or "first" point of engagement of the support means with the counterweight there is meant in the following not only the support roller of the elevator car or the support roller of the counterweight, insofar as the counterweight or the elevator car is supported by only one support roller, but also the first support roller closest to the drive pulley insofar as the counterweight of the elevator car is supported by at least two support rollers.

The deflecting roller just mentioned—which deflects the support means between the drive pulley and the first point of engagement of the support means with the elevator car—is displaceably mounted by a force store element subject to a defined prestress, so that a sensor in the case of relief of the support means of load issues a signal due to the displacing movement of the deflecting roller in its mount. This signal is preferably used for stopping the drive and the drive pulley or, however, also for a periodic reversal of the rotational direction thereof. The deflecting roller in the normal operating state, thus under the load of the tensioned support means, stands against an abutment.

Proposed solutions from the prior art, such as, for example, disclosed in International published specification WO-A1-2007/144456, similarly propose an abutment for the normal operational state when the support means is under load. The relief of the support means of load leads, due to the spring biasing force, to a movement of a transmission element away from the abutment to a limit switch. The deflecting roller monitoring device according to the invention thereagainst provides a sensor which is switched on in the normal operational state. However, as soon as the deflecting roller is urged by the force store element away from the abutment, the signal changes. Because transiting a path to a limit switch is thus eliminated, the accuracy of detection is increased and makes the monitoring device usable for wider load ranges. The load range fluctuates between the empty elevator car in the highest position, thus with the support means wound up to the maximum, and fully loaded or even over-loaded elevator car in the lowermost position, thus with the support means unwound to maximum extent.

A first more detailed variant of embodiment of the described basic variant provides at both sides of the drive pulley, i.e. not only at the support means section between the drive pulley and the first point of engagement of the support means with the elevator car, but also at the support means section between the drive pulley and the first point of engagement of the support means with the counterweight, a respective deflecting roller according to the invention. As a result, not only when the counterweight rests on the shaft floor buffers or when jamming of the counterweight occurs in its downward movement, but also when the elevator car rests on corresponding shaft floor buffers, further upward movement of the respective counter-load (elevator car or counterweight) can be avoided.

A further variant of embodiment relates to an elevator installation in which the elevator car is underslung by support means, i.e. the elevator car stands on deflecting rollers, which support it, in a loop formed by the support means. In the case of parallelly extending support means preferably two deflecting rollers according to the invention with a force store element and a sensor are respectively arranged at the lower edges of the elevator car. In this manner it is achieved that a relief of load or slackening in the support means is detectable and a signal for stopping the drive and the drive pulley or for reversal of direction of the drive pulley can be issued. In particular, in this variant of embodiment it is advantageous that the monitoring device functions independently of the intrinsic weight of the support means loop.

A further variant of embodiment of a monitoring device by means of two deflecting rollers according to the invention is suitable for any type of suspension. It does not matter whether the elevator car and/or the counterweight is or are suspended at one support roller or underslung by two supporting deflecting rollers or supported in a so-called 'rucksack suspension', because in the described instance of disturbance a tension difference between the support means at the car side and the support means at the counterweight side always arises and indeed particularly in the respective support means section closer to the drive pulley. The terms "car-side" and "counterweight-side" support means section again stand for the respective support means sections between the drive pulley and the first point of engagement of these support means with the elevator car or with the counterweight. The fact that different tensions arise between these support means sections in the case of a disturbance is exploited in this variant of embodiment in that—preferably below the drive pulley—a strut with two deflecting rollers at the ends of the strut is arranged preferably fixedly and preferably between the support means section at the car side and the support means section at the counterweight side. The deflecting rollers at the ends of the strut are, as in the case of the previous variants of the embodiment, also in accordance with the invention subject to a defined prestress of a force store element so that if slackening of one of the two support means sections occurs the deflecting roller yields to the prestress, i.e. moves outwardly, and a sensor uses this movement for generating the stop or reverse signal.

In order that the sensors at the strut do not interpret a maximum unwinding of a support means section and the thereby arising relief of load as an instance of disturbance, the strut is preferably arranged between the drive pulley and a further, fixedly arranged counter-roller for the support means or between two further, fixedly arranged counter-rollers for the support means. These additional, fixed counter-rollers are preferably easy running and produce little contact friction at the support means.

The last-described variant of embodiment with a strut between the support means sections is distinguished by cost efficiency, because instances of disturbance are detectable by only two deflecting rollers according to the invention, be it at the elevator car or at the counterweight.

The cost efficiency of the last-described variant of embodiment can, however, be further improved if the strut is equipped with a deflecting roller according to the invention only at one side. However, for preference in order that as before instances of disturbance are detectable not only at the elevator car side, but also at the counterweight side, the strut is arranged to be freely displaceable in its longitudinal direction. The latter can be realized by a rack transmission or also by merely a slot guide.

The strut can optionally also be equipped at its ends with normal, fixed deflecting rollers without a prestress of a force store element urging the deflecting roller against the support means, since the support means itself supplies a prestress. The strut, which is braced against the resistance of the two support means sections, is then constrainedly displaced out of a central position when a support means section is relieved of load. In this regard, merely a single sensor is sufficient, which detects the longitudinal displacement of the strut occurring in the case of a disturbance or the rotation of a pinion on the rack.

In the case of elevator installations in which at least two parallelly extending support means support the elevator car or the counterweight, the just-described strut according to the invention with deflecting rollers can be arranged between these two support means. As a result, the slackening, be it in the parallelly extending support means sections at the car side or in the parallelly extending support means at the counterweight side, of one of the two support means relative to the tension of the intact, operationally ready support means can be detected. However, this is not so when the elevator car or the counterweight rests on the shaft floor buffer; in that case, both support means would be relieved of load, but with progressing stretching, with progressing accumulation of fault or with breakage of only one support means.

In the case of the last-mentioned type of suspension of the elevator car or also of the counterweight with two parallelly extending support means for preference four deflecting rollers are arranged at the underside of the elevator car or the counterweight in a deflecting roller profile beam. This deflecting roller profile beam can be fastened to the underside or, however, also to the upper side of the elevator car and is preferably formed from two longitudinal sections with a connecting web, thus is H-shaped, but preferably the two longitudinal beams are connected not only with one, but with two connecting webs. At least two of the four deflecting rollers, preferably the two at the side of the elevator car or the counterweight at the shaft interior, are in that case constructed as—as previously described—monitoring devices with a deflecting roller, a force store element and a sensor.

The deflecting roller profile beam is, for enhanced monitoring of the operational state of the support means, additionally equipped in accordance with the invention with at least one load moment sensor, which is arranged in each of the two longitudinal sections approximately in the center thereof. The load moment sensors, for example bending sensors, are on the one hand capable of synchronously measuring whether the elevator car is operationally ready in the parallelly guided support means loops or has jammed in the elevator shaft during downward travel or sits on the shaft floor buffers. On the other hand, however, a different measurement signal of the two load moment sensors, which, for example, exceeds a load proportion ratio of approximately 60% to 40%, allows a conclusion to be drawn that a creeping stretching or fault accumulation adjustment of one support means relative to the other, parallel support means has arisen or the elevator car is so jammed at one side that one support means is still loaded, but the other is relieved of load. For example, from a measurement ratio of 61 to 39 the load moment sensors thus issue an appropriate control signal which is used for stopping or reversing the upward movement of the counter-load.

The enhancement of the monitoring of the operational state of support means by the afore-described deflecting roller monitoring devices with the load moment sensors, which in principle measure the deformation of the profile beam, is useful particularly in cases in which the sole monitoring by the deflecting roller monitoring devices would not detect the case of disturbance. Such a case can, for example, occur if the support means itself is jammed and the deflecting roller thus stands as before under a stress which is greater than the intrinsic prestress. The sensor of the deflecting roller monitoring device would thus not be able to issue a disturbance situation signal, but the pair of two moment sensors would detect the non-uniform loading.

A further advantage of the combination of deflecting roller monitoring device according to the invention with the load moment sensor monitoring device according to the invention is, apart from the fact that several kinds of disturbance situation as before are detectable, the fact that the load sensors usually arranged in the shaft floor buffers can be eliminated.

The deflecting roller monitoring device according to the invention is in the case of arrangement at the lower edges of the elevator car or the counterweight or in the just-described deflecting roller profile beam preferably such that the displacement of the deflecting roller or the compression and expansion of the force store element takes place in a direction which is at a 45 degree angle to the lower edge and the side wall of the elevator car or to the lower edge and the side wall of the counterweight.

The deflecting roller monitoring device according to the invention can equally also be arranged at the upper edges of the elevator car with or without the afore-described deflecting roller profile beam. Arrangements are also realizable with appropriately designed force store elements in which the elevator car or the counterweight is suspended at a single roller. Moreover, an arrangement of one or more deflecting roller monitoring devices according to the invention is possible at a deflecting roller which is arranged at a support means fixing point in the elevator shaft.

In the case of a further possible variant of embodiment the deflecting roller is mounted in a hinge housing which is subject to defined spring-loading.

The force store element can be a conventional compression spring which is guided in a housing or on a pin. However, gas pressure springs or leaf springs or plate springs also come into consideration, in which a contact sensor detects the displacement of an individual leaf or plate.

The sensor measurement is preferably carried out at a settable time interval. Detection by the sensor or sensors of individual load moment peaks and reliefs of load consequent thereon due to the resilience intrinsic to the system as a disturbance situation, although none is yet present, is thereby avoided. Such transient load and load relief peaks can occur, for example, because an only temporary jamming or breakaway is present or a heavy load in the elevator car drops from a stack or, for example, passengers or children in the elevator car synchronously jump.

DESCRIPTION OF THE DRAWINGS

The invention is explained in more detail symbolically and by way of example on the basis of figures. The figures are described conjunctively and in general. The same reference numerals signify the same components and reference numerals with different indices indicate functionally equivalent or similar components.

In that case.

DETAILED DESCRIPTION OF THE INVENTION

Figure 1:
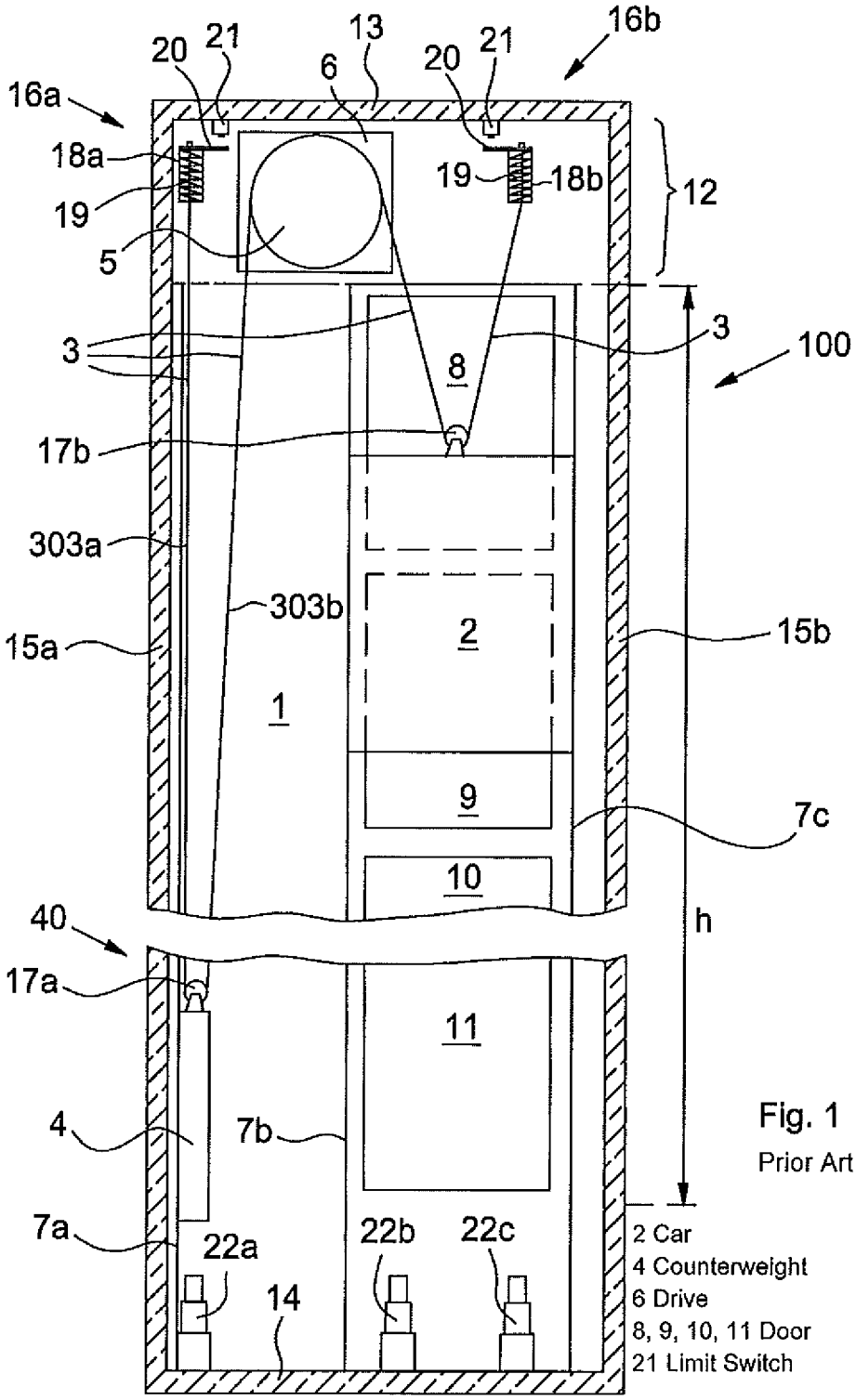
Fig. 1 Prior Art
FIG. 1 shows a schematic illustration of an elevator installation with a respective monitoring device at the stationary fastening points of the support means, according to the prior art.

FIG. 1 shows an elevator installation 100 such as is known from the prior art. An elevator car 2 is arranged in the elevator shaft 1 to be movable and is connected by way of a support means or apparatus 3 with a movable counterweight 4. During operation the support means or apparatus 3 is driven by a drive pulley 5 of a drive unit 6, which is arranged in the uppermost region of the elevator shaft 1, for example in the shaft head 12 or in the engine room 12. The elevator car 2 and the counterweight 4 are guided by means of guide rails 7*a* or 7*b* and 7*c* extending over the shaft height.

The elevator car 2 can over a conveying height h serve an uppermost floor door 8, further floor doors 9 and 10 and a lowermost floor door 11. The elevator shaft 1 is formed from shaft side walls 15*a* and 15*b*, a shaft ceiling 13 and a shaft floor 14, on which a shaft floor buffer 22*a* for the counterweight 4 and two shaft buffers 22*b* and 22*c* for the elevator car 2 are arranged.

The support means or apparatus 3 is fastened to a stationary fastening point or support means fastening point 18*a* at the shaft ceiling 13 and is guided parallel to the shaft side wall 15*a* to a support roller 17*a* for the counterweight 4. From here it again goes back via the drive pulley 5 to a support roller 17*b* for the elevator car 2 and to a second stationary fastening point or support means fixing point 18*b* at the shaft ceiling 13.

A respective monitoring device 16*a* and 16*b* is formed at the support means fixing point 18*a* or 18*b*, in that in each instance a spring 19 which accepts the load of the support means or apparatus 3 is arranged. In the case of a downward movement and seating of the counterweight 4 on the shaft floor buffer 22*a* the drive pulley 5 continues its rotation in counter-clockwise sense and lifts the elevator car 2 further without compensation for the elevator car 2 being provided by the counter-load of the counterweight 4. The detection of relief of the support means 3 of load thus takes place at a support means section 303*a*, which is at the shaft wall side, between the fixing point 18*a* and the support roller 17*a* or at a (first) point 40 of engagement of the support means 3 with the counterweight 4. This support means section 303*a* is indeed relieved of load, but due to the rotation of the drive pulley 5 a load relief, which is detectable earlier, of a support means section 303*b*, which is at the counterweight side, between the drive pulley 5 and the support roller 17*a* or the (first) point 40 of engagement of the support means 3 with the counterweight 4 takes place. This latter support means section 303*b* at the counterweight side is dropped down at the right-hand side, which is at the shaft interior, of the counterweight 4 and the support roller 17*a* thus represents an obstacle to detection of the slackening of the support means 3. This signifies a disadvantage of the prior art solution, which is eliminated by the solution according to the invention.

The spring 19 of the known monitoring device 16*a* then urges, as a consequence of the omission of tension loading by the support means 3, a transmission element 20 against a limit switch 21, which switches off the drive 6.

The monitoring device 16*b* on the elevator car side functions analogously in order in the case of seating of the elevator car 2 to avoid further pulling up of the counterweight 4. With this monitoring device 16*b* on the elevator car side a further disadvantage of the prior art solution on the basis of a calculated example is obvious: The force of the spring 19 has to be designed so that it is still not triggered in the case of a load of an empty elevator car 2 (for example 300 kg) plus the load of the support means between the monitoring device 16*b* and the support roller 17*b* (for example 100 kg) plus the load of this support beams between the support roller 17*b* and the drive pulley 5 (100 kg), thus in the case of an assumed 500 kg. Only then is it possible to guarantee, for example, a jamming of the empty elevator car 2 in a highest shaft position, thus in the case of a smallest possible support means weight. A spring force of approximately 400 kp favoring a not too sensitive triggering would thus be selected. However, if the weight of the two support means in the uppermost floor position 8 is already 200 kg and as a consequence of an assumed conveying height h of only ten floors can be multiplied by approximately ten, then the 400 kp of the spring is not sufficient to lift an approximately fivefold load. Thus, regardless of whether the elevator car 2 hangs operationally ready in the support means loop or stands on the shaft floor buffers the monitoring device 16*b* cannot detect the load relief of the support means 3.

Monitoring devices according to the prior art, which function by way of the total tension load in the support means 3, thus do not come into consideration for elevator installations 100 with large conveying heights h and, in addition, stand in the way of modern elevator car lightweight construction.

Figure 2:
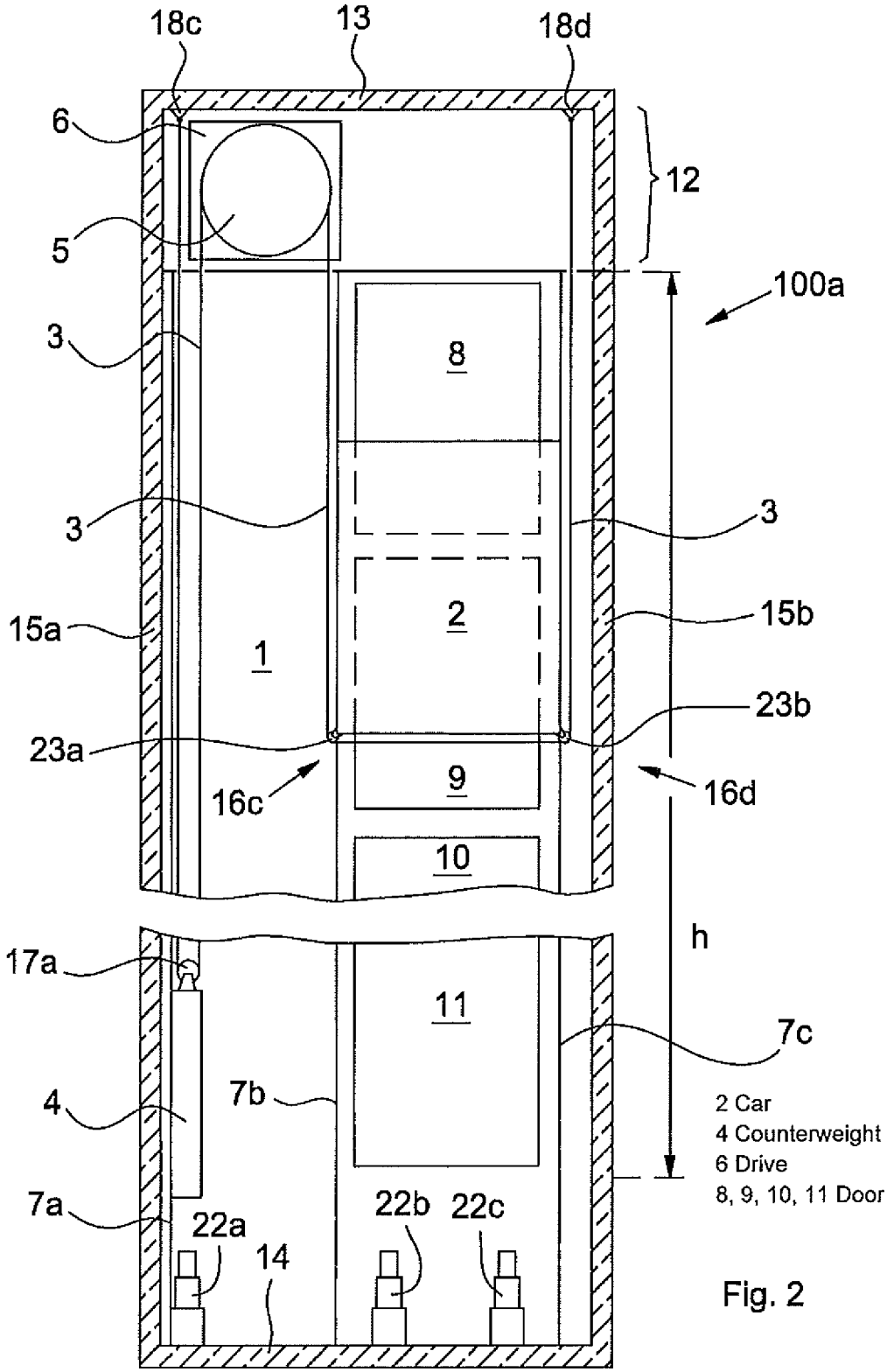
FIG. 2 shows a schematic illustration of an elevator installation according to the invention with a monitoring device according to the invention at supporting deflecting rollers of the elevator car.

FIG. 2 schematically shows an elevator installation 100*a* according to the invention in which the monitoring devices 16*c* and 16*d* are no longer combined with the fastening points 18*c* and 18*d*, but are combined with deflecting rollers 23*a* and 23*b*. If the elevator car 2 with underslinging should in the case of its downward travel set down on the shaft floor buffers 22*b* and 22*c*, the deflecting roller monitoring devices 16*c* and 16*d* detect the slackening of the support means loop carrying the elevator car 2.

Figure 3:
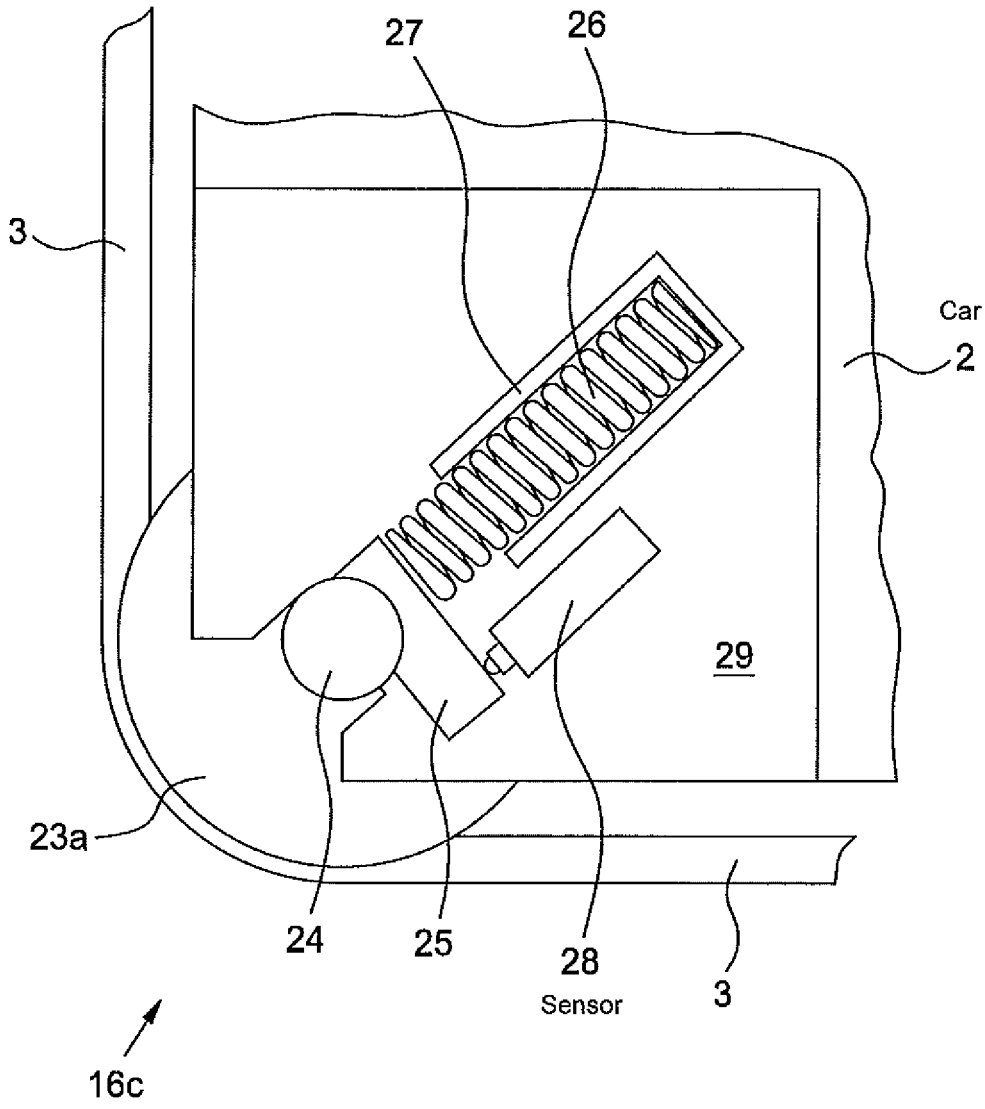
FIG. 3 shows a schematic detailed illustration of a deflecting roller monitoring device according to the invention.

The deflecting roller monitoring device 16*c* according to the invention of FIG. 2 is schematically illustrated in FIG. 3. The deflecting roller 23*a* stands in the support means 3 and, in the normal operational state, by an axle mount 24 against an abutment 25. A guide housing 27 for a force store element 26 and a sensor 28 is arranged at a frame 29 fastened to the elevator car 2. The sensor 28 in the normal operational setting is in contact with the abutment 25. If a relief of the support means 3 of load occurs, the force store element 26 urges the deflecting roller 23*a* and the abutment 25 away from the sensor 28. Triggering of the sensor 28 thus takes place even with the first irregularities and not only after a travel of the abutment 25 up to a limit switch has been described.

The prestress force of the force store element 26, which is exerted against the deflecting roller 23*a* by way of the abutment 25 and by way of the axle mount 24, is smaller than the load of the empty elevator car 2 and advantageously not influenced by the intrinsic weight of the support means 3.

Figure 4:
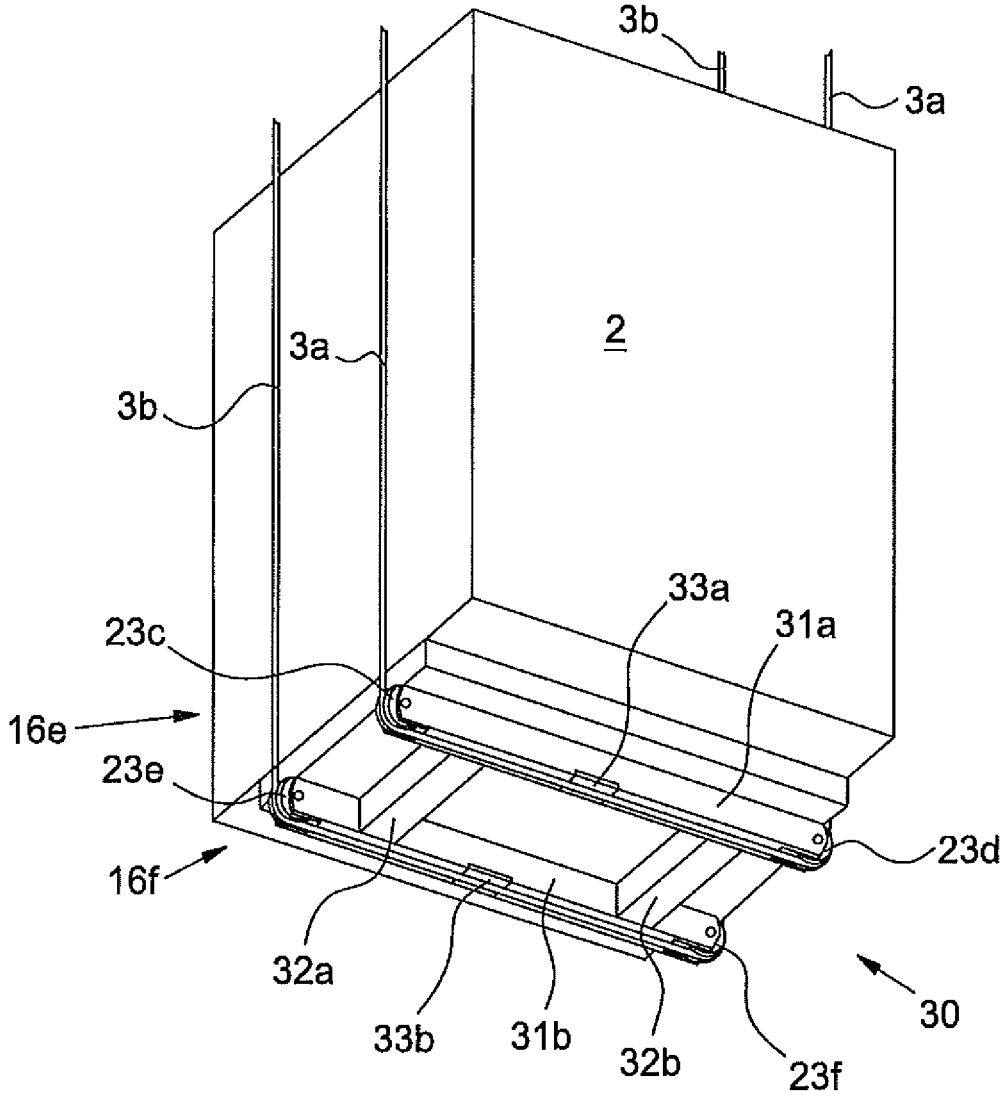
FIG. 4 shows a schematic illustration of a deflecting roller profile beam according to the invention at the underside of an elevator car.

FIG. 4 schematically shows an enhancement in accordance with the invention of two parallelly arranged deflecting roller monitoring devices 16*e* and 16*f* with a deflecting roller profile beam 30 in a parallelly guided underslinging of the elevator car 2 by a first support means 3*a* via deflecting rollers 23*c* and 23*d* and a second support means 3*b* via deflecting rollers 23*e* and 23*f*. The deflecting roller profile beam 30 is arranged at the underside of the elevator car 2 and consists of two longitudinal sections 31*a* and 31*b* which are connected together by two connecting webs 32*a* and 32*b*. Arranged approximately halfway in each of the two longitudinal sections 31*a* and 31*b* is a respective load moment sensor 33*a* or 33*b*.

The load moment sensors 33*a* and 33*b* are for their part in a position of measuring seating of the elevator car 2 due to the absence of its load. This can also be undertaken by the monitoring devices 16*e* and 16*f*. However, on the other hand the load moment sensors 33*a* and 33*b* deliver a measurement signal if a deformation arises in the deflecting roller profile beam 30 due to unequal tensions in the support means 3*a* and 3*b*. The output of a control signal for stopping the elevator installation is preferably triggered as soon as the measurement of the load moment sensor 33*a* or 33*b* begins to exceed 60% of the car load and the measurement of the other load moment sensor 33*b* or 33*a* begins to fall below 40%.

Figure 5:
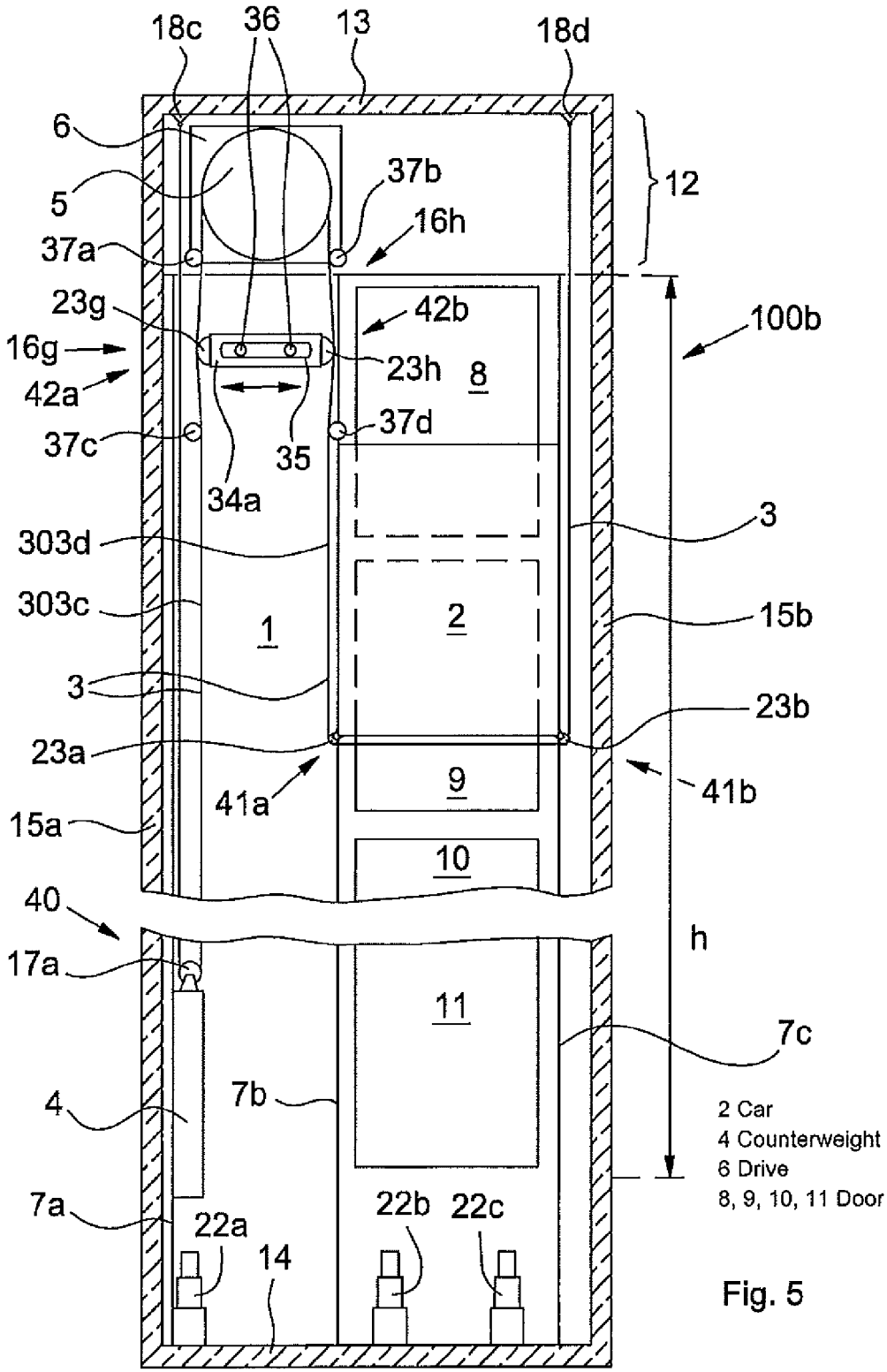
FIG. 5 shows a further variant of embodiment of an elevator installation according to the invention with a monitoring device according to the invention with two deflecting rollers at a strut.

FIG. 5 schematically shows an elevator installation 100*b* in which deflecting roller monitoring devices 16*g* and 16*h* are arranged at a strut 34*a* with deflecting rollers 23*g* and 23*h*. The strut 34*a* is arranged in stationary position in the elevator shaft 1 and thus the deflecting roller 23*g* represents a support means fixing point 42*a* for the support means or apparatus 3 at a support means section 303*c* and the deflecting roller 23*h* represents a support means fixing point 42*b* for the support means 3 at a support means section 303*d*. The support means section 303*c* extends from the drive pulley 5 up to a (first) point 40 of engagement of the support means 3 with the counterweight 4, which again in this case is nothing other than the support roller 17*a*. The support means section 303*d*, thereagainst, extends from the drive pulley 5 up to a first point 41*a* of engagement of the support means 3 with the elevator car 2, which in this case is the supporting deflecting roller 23*a*. The supporting deflecting roller 23*b* represents a second point 41*b* of engagement of the support means 3 with the elevator car 2. In addition to the monitoring devices 16*g* and 16*h* the supporting deflecting roller 23*a* and/or also the supporting deflecting roller 23*b* can also have a monitoring device corresponding with the monitoring devices of FIGS. 2 to 4.

The strut 34*a* with the deflecting rollers 23*g* and 23*h* is arranged between the support means section 303*c* and the support means section 303*d*. The strut 34*a* is, in particular, fixedly arranged by fastenings 36 in the elevator shaft 1, but can yield horizontally, by means of a slot 35, to the pressure which in the case of disturbance an intact support means section 303*c* or 303*d* would reciprocally exert on the other support means section 303*d* or 303*c*.

The deflecting roller monitoring devices 16*g* and 16*h* can be designed as before. However, the sensor can optionally also be arranged at the fastenings 36.

In order that the sensor at the fastenings 36 or the sensors of the deflecting roller monitoring devices 16*g* and 16*h* do not detect the tension differences, which occur in normal operation during a travel, in the support means section 303*c* and 303*d*, i.e. the increasing or maximum unwinding with simultaneous increasing or maximum winding-up of the other support means section 303*d* or 303*c*, as an instance of disturbance the strut 34*a* is, as illustrated, arranged between counter-rollers 37*a*-37*d*.

Figure 6:
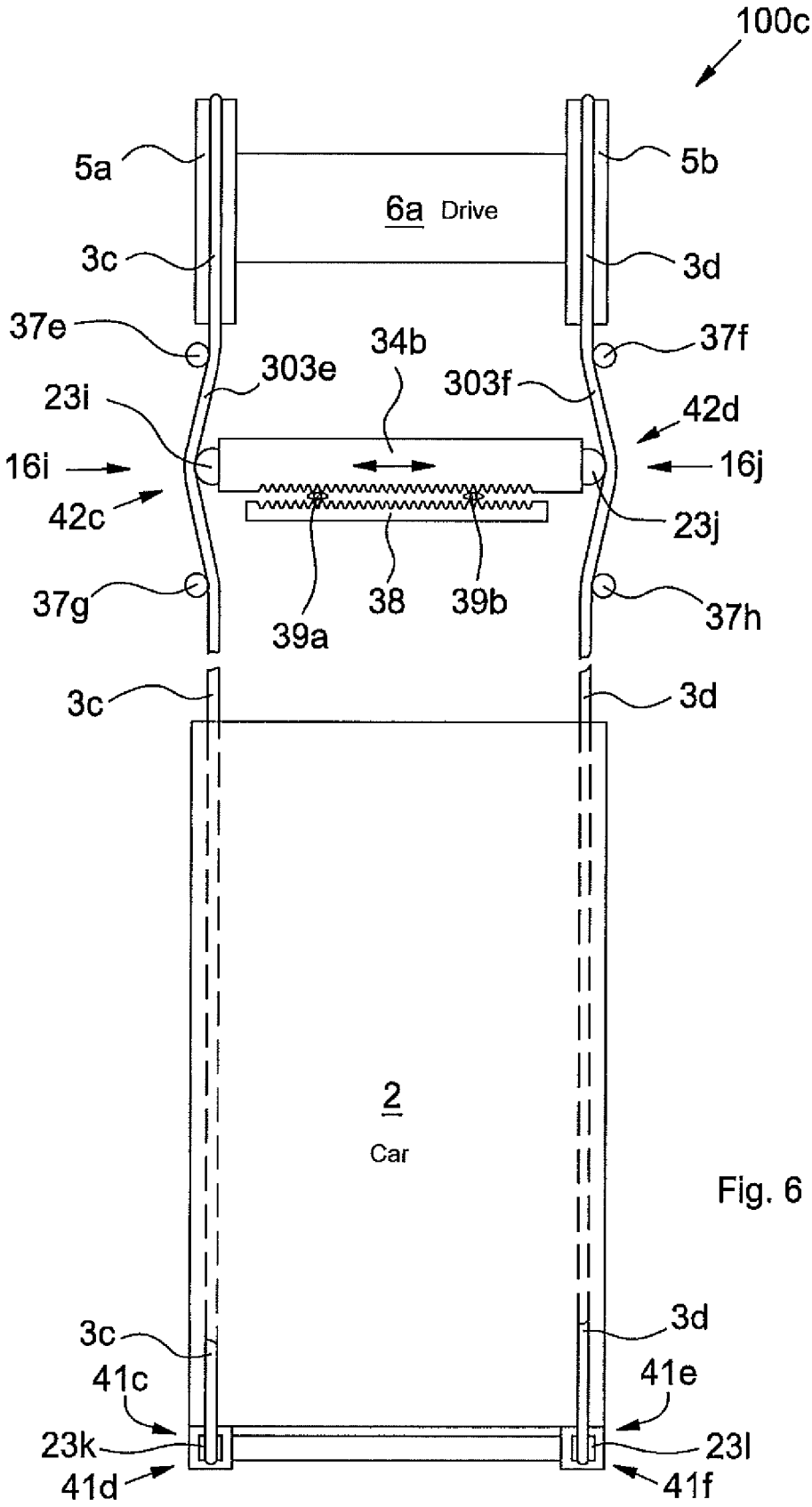
FIG. 6 shows a further variant of embodiment of a monitoring device according to the invention with two deflecting rollers at a strut.

FIG. 6 schematically shows the elevator car 2 in a parallel underslinging suspension as in FIG. 4, with a first support means 3*c* and a second support means 3*d*, which are driven synchronously by drive pulleys 5*a* and 5*b* or by a common drive unit 6*a*. By means of a strut 34*b* pressing the deflecting rollers 23*i* and 23*j* against the support means 3*c* and 3*d* or by means of the—as previously disclosed—deflecting roller monitoring devices 16*i* and 16*j* a monitoring of the individual support means 3*c* and 3*d* of a parallel support means suspension is realized in that manner. The deflecting roller 23*i* thus represents a support means fixing point 42*c* for the support means 3*c* at a support means section 303*e* and the deflecting roller 23*j* represents a support means fixing point 42*d* for the support means 3*d* at a support means section 303*f*.

The support means section 303*e* extends from the drive pulley 5*a* up to a supporting deflecting roller which in the illustrated lateral plan view of the elevator car 2 is concealed by a supporting deflecting roller 23*k*. This concealed supporting deflecting roller thus represents a first point 41*c* of engagement of the support means 3*c* with the elevator car 2 and the visible supporting deflecting roller 23*k* represents a second point 41*d* of engagement of the support means 3*c* with the elevator car 2. The same applies analogously to the support means 3*d*, which has a support means section 303*f* from the drive pulley 5*b* up to a supporting deflecting roller, which is concealed by a supporting deflecting roller 23*l*. Thus, also at this side of the elevator car mention can be made of a first point 41*e* of engagement of the support means 3*d* with the elevator car 2 and a second point 41*f* of engagement of the support means 3*d* with the elevator car 2. Optionally, in addition to the monitoring devices 16*i* and 16*j* the not visible supporting deflecting rollers and/or the supporting deflecting rollers 23*k* and 23*l* can have monitoring devices which correspond with the monitoring devices 16*c*-16*f* of FIGS. 2 to 4.

As in FIG. 5 also, for avoidance of detection of the maximum unwinding of the support means 3*c* and 3*d* as slackening in the case of disturbance, counter-rollers 37*e*-37*h* are arranged as illustrated.

In the case of use of a flat belt or a profiled belt (for example a wedge-ribbed belt) as support means 3*c* or 3*d*, the narrow or profiled sides of the support means 3*c* or 3*d* can represent an unfavorable guide surface for the counter-rollers 37*e*-37*h* and the deflecting rollers 23*i* and 23*j*. However, in order to achieve a stable guidance in the counter-rollers 37*e*-37*h* and the deflecting rollers 23*i* and 23*j*, on the one hand cables according to the invention with a round cross-section are used as support means 3*c* and 3*d* or a flat belt with approximately square cross-section, preferably in each instance with a side surface offering a sufficiently wide guide surface so that the support means 3*c* or 3*d* is not twisted. On the other hand, according to the invention the counter-rollers 37*e*-37*h* can be arranged at the same time as aligning rollers or aligning roller pairs, which turns the cross-section of a flat belt above the deflecting roller 23*i* or 23*j* through, for example, 90 degrees and turns it back again below the deflecting roller 23*l* or 23*j*. In the case of a wedge-ribbed belt a turning of, for example, approximately 60 degrees can suffice.

By contrast to FIG. 5, the strut 34*b* stands by preferably two pinions 39*a* and 39*b* on a rack 38 fixedly arranged in the elevator shaft 1. A horizontal displacement, which occurs as a consequence of a non-uniformity in the support means 3*c* and 3*d*, of the strut 34*b* thus manifests itself as a rotation of the pinions 39*a* and 39*b*. The deflecting roller monitoring devices 16*i* and 16*j* can as customary have individual sensors, but optionally also a single sensor detecting the rotation of one of the pinions 39*a* and 39*b* suffices.

The combination of the depicted variants of embodiment of monitoring devices according to the invention is hereby disclosed. Thus, the monitoring devices 16*c*-16*f* shown in FIGS. 2 to 4 can be combined in a single elevator installation 100 with the monitoring devices 16*g* and 16*h* of FIG. 5 and/or with the monitoring devices 16*i* and 16*j* of FIG. 6. Moreover, the monitoring devices 16*g* and 16*h* of FIG. 5 and the monitoring devices 16*i* and 16*j* of FIG. 6 can be combined in a single elevator installation 100.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having an elevator car and a counterweight, which car and counterweight are movable in opposite sense along guide rails in an elevator shaft by a support apparatus guided over a drive pulley of a drive, and a monitoring device for detection of slackening of the support apparatus, wherein the drive pulley is arranged between two stationary support apparatus fastening points in the shaft and the support apparatus is guided over the drive pulley to form two loops, and wherein the car is supported in one of the two loops and the counterweight is supported in another of the two loops, comprising:

the monitoring device being arranged at a roller, the roller being arranged at the car or the counterweight;

the monitoring device including a sensor which is switched on in a normal operating state of the elevator installation for monitoring a load on the support apparatus; and the roller being displaceably mounted by a force store element, which element is subject to a defined prestress force, whereby in response to relief of the load on the support apparatus, the force store element displaces the roller to actuate the switched on sensor to issue a load relief detection signal.

2. The elevator installation according to claim 1 wherein the roller is pressed against the support apparatus by the defined prestress force of the force store element which force is smaller than a tension of the support apparatus in the normal operating state, whereby upon relief of the load on the support apparatus, the deflecting roller is displaceable by the prestress force of the force store element to enable the detection signal to be issued by the sensor.

3. The elevator installation according to claim 1 including an abutment connected to the roller and in contact with the sensor whereby the force store element urges the roller and the abutment away from the sensor.

4. The elevator installation according to claim 1 wherein the support apparatus supports the car and the counterweight with a first support means and a second support means engaging at least four deflecting rollers arranged at a deflecting roller profile beam attached to the car, the beam including two longitudinal sections and at least one connecting web.

5. The elevator installation according to claim 4 including at least one load moment sensor arranged at each of the longitudinal sections for sensing relief of the load on the support apparatus.

6. The elevator installation according to claim 5 wherein each of the load moment sensors generates a signal upon measuring more than 60% of the load being on an associated one of the two longitudinal sections.

7. The elevator installation according to claim 5 wherein the load moment sensors sense during a settable interval in time.

8. The elevator installation according to claim 1 wherein the sensor is switched on during a settable interval in time.

9. An elevator installation having an elevator car and a counterweight, which car and counterweight are movable in opposite sense along guide rails in an elevator shaft by a support apparatus guided over a drive pulley of a drive, and a pair of monitoring devices for detection of slackening of the support apparatus, wherein the drive pulley is arranged between two stationary support apparatus fastening points in the shaft and the support apparatus is guided over the drive pulley to form two loops, and wherein the car is supported in one of the two loops and the counterweight is supported in another of the two loops, comprising:

a strut mounted in the shaft;

each monitoring device of the pair of monitoring devices being arranged at an associated roller of a pair of rollers, the rollers being arranged on the strut and each of the rollers engaging an associated one of the two loops; and each of the monitoring devices including a sensor which is switched on in a normal operating state of the elevator installation for monitoring a load on the support apparatus.

10. The elevator installation according to claim 9 wherein the strut is movable horizontally in response to pressure by the support apparatus.

11. The elevator installation according to claim 10 wherein the strut includes a slot engaged by fastenings in the shaft.

12. The elevator installation according to claim 10 wherein the strut is coupled by pinions to a rack arranged in the shaft.

13. The elevator installation according to claim 9 including a plurality of counter-rollers engaging the support apparatus adjacent the rollers to prevent the sensors from detecting tension differences during normal travel of the car in the shaft.

14. The elevator installation according to claim 9 wherein each of the rollers is displaceably mounted by an associated force store element, which element is subject to a defined prestress force, whereby in response to relief of the load on the support apparatus, the force store element displaces the associated roller to actuate the switched on sensor to issue a load relief detection signal.

15. The elevator installation according to claim 9 wherein the sensors are switched on during a settable interval in time.

16. The elevator installation according to claim 9 including an abutment connected to each of the rollers and in contact with the sensor whereby the force store element urges the roller and the abutment away from the sensor.

17. The elevator installation according to claim 9 wherein the support apparatus supports the car and the counterweight with a first support means and a second support means engaging at least four deflecting rollers arranged at a deflecting roller profile beam attached to the car, the beam including two longitudinal sections and at least one connecting web.

18. The elevator installation according to claim 17 including at least one load moment sensor arranged at each of the longitudinal sections for sensing relief of the load on the support apparatus.

19. The elevator installation according to claim 18 wherein each of the load moment sensors generates a signal upon measuring more than 60% of the load being on an associated one of the two longitudinal sections.

* * * * *